United States Patent [19]

Stannow et al.

[11] 4,106,881

[45] Aug. 15, 1978

[54] ENCAPSULATED MOTOR COMPRESSOR FOR REFRIGERATORS

[75] Inventors: Jorgen Christian Stannow; Hans Jürgen Tankred, both of Sonderborg, Denmark

[73] Assignee: Danfoss A/S, Nordborg, Denmark

[21] Appl. No.: 786,421

[22] Filed: Apr. 11, 1977

[30] Foreign Application Priority Data

Apr. 21, 1976 [DE] Fed. Rep. of Germany ..... 2617388

[51] Int. Cl.[2] ..... F04B 35/00

[52] U.S. Cl. ..... 417/363; 417/902; 310/51; 248/21

[58] Field of Search ..... 417/363, 902, 415; 310/51; 248/21; 62/295, 296

[56] References Cited

U.S. PATENT DOCUMENTS

| | | | |
|---|---|---|---|
| 2,270,335 | 1/1942 | Parkinson et al. | 248/21 |
| 2,386,248 | 10/1945 | Marzetti | 248/21 |
| 3,016,183 | 1/1962 | Murphy et al. | 417/902 X |
| 3,689,203 | 9/1972 | Vaughn | 417/363 X |
| 3,897,177 | 7/1975 | Parker | 417/363 |

*Primary Examiner*—Carlton R. Croyle
*Assistant Examiner*—R. E. Gluck

[57] ABSTRACT

The invention relates to a refrigeration type motor compressor assembly in which an integrated motor compressor unit is resiliently mounted. The motor stator includes a stack of rectangularly shaped laminations with bevelled corners. Stator bolts extend upwardly through the laminations with the bolt heads projecting downwardly from the lower surface of the laminations. The resilient suspension system includes four generally cone shaped spring retaining abutment members attachable from below to the four corners of the stack of laminations. These abutment members have recesses for receiving the bolt heads and collars which extend outwardly beyond the bevelled corners of the stack of laminations. The collars are abuttingly engageable with the inner surface of the casing during lateral movement of the spring mounted motor compressor unit to provide bumper protection for this unit.

1 Claim, 3 Drawing Figures

ENCAPSULATED MOTOR COMPRESSOR FOR REFRIGERATORS

The invention relates to an encapsulated motor compressor for refrigerators, comprising a vertical motor axis, a compressor disposed at the top, a resilient suspension, abutments on the motor compressor co-operating with counterbearings fixed with respect to the capsule to prevent damage during transport, and a capsule having an enlargement to accommodate a radially projecting portion of the cylinder arrangement and an electric lead-in in its wall.

Motor compressors of this kind are nowadays in general use. The spacing between the capsule and the motor compressor is selected so that, having regard to the springs used, there is no danger during normal operation of the motor compressor striking the capsule. Larger impacts of the kind occurring during transport result in the abutments coming to lie against the associated counterbearings so that damage of the motor compressor is likewise avoided. It is known to combine such abutments with securing means for the springs and to arrange them between the cylinder and the motor or at the level of the centre of gravity of the motor compressor. The electric lead-in projects inwardly from the wall of the capsule. Difficulties are therefore presented in protecting this lead-in from damage by the motor compressor during transport if the capsule is to be kept as small as possible.

The invention is based on the problem of providing a motor compressor of the aforementioned kind in which the motor compressor and the lead-in are safely protected from impacts during transport.

This problem is solved according to the invention in that a plurality of abutments at the underside of the stator project laterally beyond the stator laminations and that inwardly offset counterbearings are provided in the enlargement at the level of the abutments, the electric lead-in being disposed between said counterbearings.

The lead-in arranged between the counterbearings is accommodated in a well-protected manner because counterbearings for the abutment of the motor compressor are disposed on both sides of it. Since the abutments are provided on the underside of the stator, i.e. they have a certain spacing from the cylinder arrangement, the lead-in as well as the two counterbearings protecting same can be accommodated in the capsule enlargement that is already present, so that no additional space is required for this purpose.

A further advantage resides in the fact that the counterbearings can be at least partially formed directly by the capsule wall. This also applies to the inwardly offset counterbearings which may be formed by indentations in the capsule wall extending over part of the height.

In a preferred embodiment, the abutments are disposed at the four corners of a rectangular stack of stator laminations, the corners being bevelled, the associated counterbearings formed at least partially by the capsule wall also extend obliquely, and the abutments project to such an extent that they tend to touch the counterbearing in every direction of motion transversely to the motor axis. In this way sufficiently small spacings will suffice between the capsule wall and the stack of stator laminations. Each abutment serves to limit movement in different directions.

Particularly advantageously, the abutments consist of plastics material. When striking the counterbearings, no metallic particles will than be worn off. In addition, the plastics can absorb part of the impact energy by elastic or plastic deformation. An adequately soft plastics material resistant to the refrigerant is for example tetrafluoroethylene.

It is favourable if the abutments are cylindrical and have a central aperture for placing over the head of a stator bolt. This facilitates assembly. An alignment of the abutments is not necessary.

Further, the abutments may be formed by a collar on a mounting for supporting helical compression springs.

In addition, it is recommended that each spring be disposed between two mountings each having a cylindrical retaining portion for wedgingly holding the spring and of which at least one has an extension projecting up to the vicinity of the other mounting when the springs are loaded by the weight of the motor compressor. These mountings are then simultaneously employed as transport abutments for vertical movements of the motor compressor.

Outwardly directed motion can for example be limited in that above the stator on the side opposite to the cylinder arrangement the capsule is provided with an inwardly directed projection arranged at a slight vertical spacing from the top of the stator or a beam attached thereto. Such an arrangement need only be provided on one side of the motor compressor if the vertical spacing between the top of the cylinder arrangment and the capsule wall is substantially as large as the vertical spacing between the projection and the top of the stator or beam.

This invention will now be described in more detail with reference to an example illustrated in the drawing, wherein.

Figure 1:
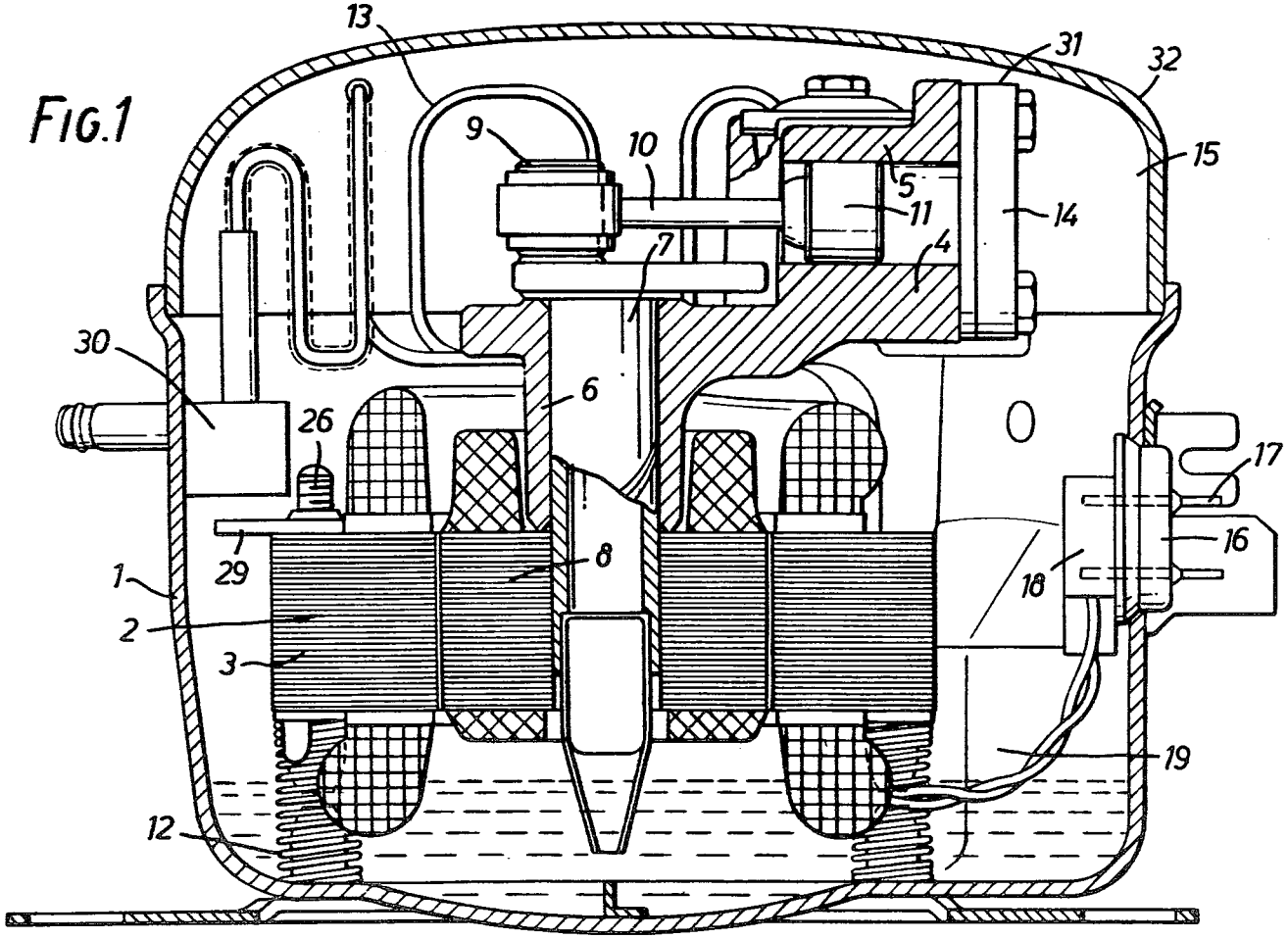
FIG. 1 is a vertical section through a motor compressor according to the invention.

A motor compressor 2 is disposed in a capsule 1. A component 4 connected to a stator 3 comprises the cylinder 5 and a bearing 6. Mounted in the bearing there is a motor shaft 7 which carries the rotor 8 and drives the piston 11 through a crank pin 9 and a connecting rod 10. Helical compression springs 12 support the motor compressor resiliently. A pressure tube 13 is also resiliently constructed.

Figure 2:
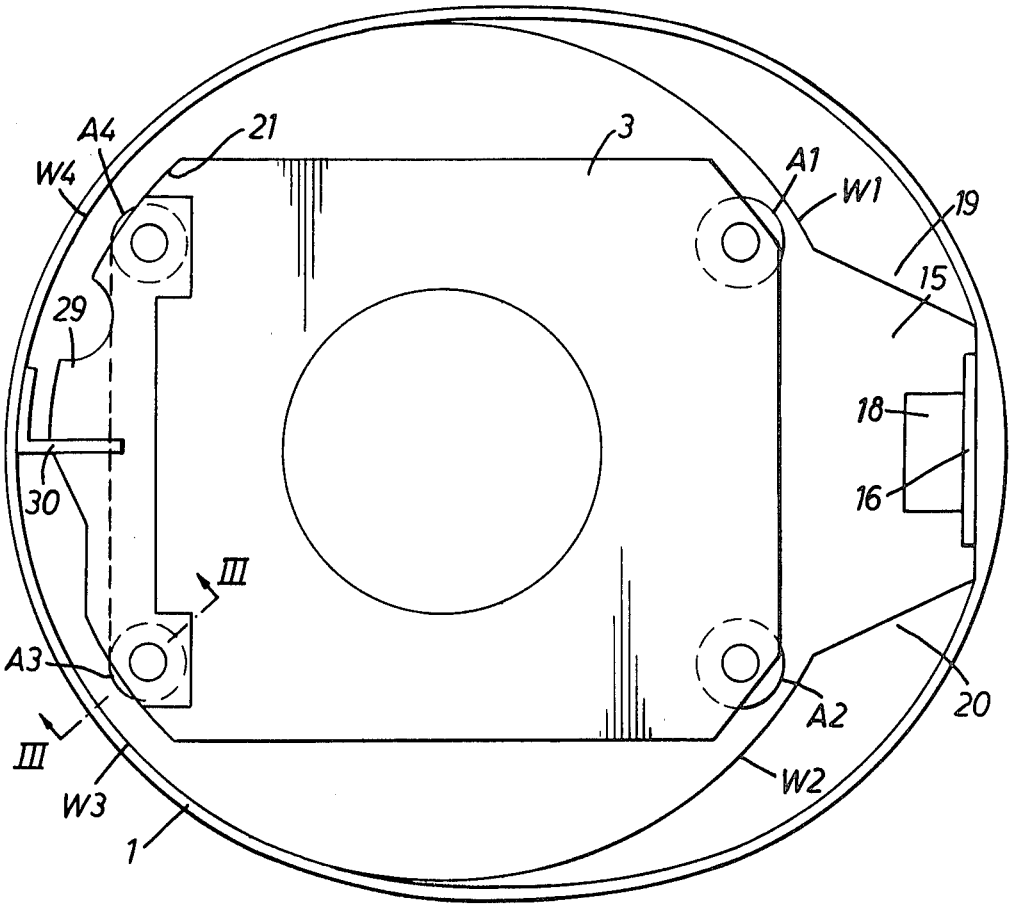
FIG. 2 is a diagrammatic plan view of the open capsule.
Figure 3:
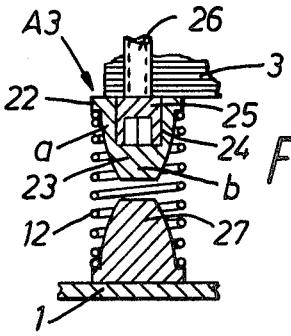
FIG. 3 is a section on the line III—III in FIG. 2.

To receive the cylinder head 14 projecting radially beyond the stator, the capsule has an enlargement 15. In this enlargement there is also an electric lead-in 16 having lead-in pins 17 on the inner ends of which there is a plug 18. Indentations 19 and 20 are provided in the lower portion of the capsule to both sides of the lead-in 16. In this way the wall of the capsule forms four counterbearings W1–W4 which can co-operate with four abutments A1–A4 provided on the motor compressor 2. These abutments are located on the underside of the rectangular stator 3. Its corners 21 are bevelled so that they will everywhere have about the same spacing from the respective counterbearings W1–W4. The abutments A1–A4 project beyond these bevelled corners in such a way that they limit displacement of the motor compressor in any direction in the plane of the drawing of FIG. 2 by abutting against the counterbearing. In this way the lead-in 16 and the plug 18 are safely protected between the indentations 19 and 20.

The abutments are formed by the collar 22 of a mounting 23 for helical compression springs 12. Tbis mounting comprises a recess 24 by means of which it is placed over the head 25 of a stator bolt 26. A similar mounting 27 of metal is welded to the base of the capsule 1. The mountings have a cylindrical retaining portion a onto which the spring 12 is clamped and an adjoining extension b. The mounting 23 may be of plastics material that is resistant to the refrigerant. Upon vertical displacement of the motor compressor in the downward direction, they also serve as transport abutments.

To prevent excessive upward displacement of the motor compressor, a cantilever beam 29 is secured to the top of the stator on the side opposite to the cylinder, the securing being likewise effected by means of the stator bolts 26. In addition, an angular projection 30 is secured to the capsule at a small spacing above the beam 29. The top 31 of the cylinder head 14 is at substantially the same spacing from the covering wall 32 of the capsule.

The beam 29 has the advantage that the projection 30 can be kept comparatively short and it therefore makes no contact with the winding head even when there is extreme displacement. However, with a somewhat longer projection 30 one may also dispense with the beam 29, in which case there will be abutment directly with the top of the stator.

We claim:

1. A motor compressor assembly for refrigerators comprising a casing, an integrated motor and compressor unit in said casing having a lower motor part and an upper compressor part, said motor part having a stator which includes a stack of laminations, said stack of laminations having a generally rectangularly shape periphery with four bevelled corners, stator bolts extending upwardly through said stack of laminations at the four corners thereof with the heads of said bolts projecting downwardly from the lower surface of said stack of laminations, resilient mounting means for supporting said unit, said mounting means including four generally cone shaped spring retaining abutment members attachable from below to the four corners of said stack of laminations, said abutment members having recesses for receiving said bolt heads and collars which extend outwardly beyond said bevelled corners of said stack of laminations, said collars being abuttingly engageable with the inner surface of said casing during lateral movement of said unit to provide bumper protection for said unit, and spring means including helical springs which respectively engage said collars.

* * * * *